United States Patent [19]

Holtz

[11] 4,345,345

[45] Aug. 24, 1982

[54] HEAD SUPPORT

[76] Inventor: Leonard Holtz, 418 Jordan St., Oceanside, N.Y. 11572

[21] Appl. No.: 151,908

[22] Filed: May 21, 1980

[51] Int. Cl.[3] ..... A47G 9/00

[52] U.S. Cl. ..... 5/437; 5/441

[58] Field of Search ..... 5/431, 434, 436, 437, 5/441, 442, 465, 455; 24/72.5; 297/391, 397

[56] References Cited

U.S. PATENT DOCUMENTS

| | | | |
|---|---|---|---|
| 716,752 | 12/1902 | Phillips | 5/455 |
| 941,043 | 11/1909 | Powell | 5/436 |
| 2,589,476 | 3/1952 | Casey | 24/72.5 |
| 2,952,856 | 9/1960 | Ruff | 5/437 |
| 2,988,759 | 6/1961 | Gerdes | 24/42.5 |
| 3,052,891 | 9/1962 | Panepinto | 2/326 |
| 3,092,848 | 6/1963 | Gronvold | 5/495 |
| 3,911,512 | 10/1975 | Plate | 5/465 |
| 4,274,673 | 6/1981 | Kifferstein | 5/437 |

FOREIGN PATENT DOCUMENTS

| | | | |
|---|---|---|---|
| 733980 | 7/1955 | United Kingdom | 5/498 |

*Primary Examiner*—Alexander Grosz

*Attorney, Agent, or Firm*—Frishauf, Holtz, Goodman & Woodward

[57] ABSTRACT

A head support for use on airplanes, buses and the like comprises a pair of pillows and an interconnecting member connecting the pillows with a spacing therebetween. Two interconnecting members may be provided. The interconnecting member is preferably releasably connected to the pillows and may be elastic or non-elastic.

7 Claims, 8 Drawing Figures

HEAD SUPPORT

BACKGROUND OF THE INVENTION

This invention relates to a head support, and more particularly to a head support which is particularly useful for travelers in airplanes, trains, buses, etc.

Seats in airplanes, trains, buses and the like generally have high backs for supporting the head of a traveler. However, there is no lateral or side-to-side support and if the traveler falls asleep, his head generally falls over to one side, causing neck pains.

The object of this invention is to provide a head support arrangement which is particularly adaptable for use in airplanes, buses, trains or the like.

A further object is to provide a head support arrangement which can utilize the standard-type pillows generally provided on airlines, trains, etc.

SUMMARY OF THE INVENTION

In accordance with the present invention, a head support arrangement comprises a pair of pillows or the like and an interconnecting member connecting the pillows with a spacing therebetween. In a preferred arrangement, the spacing is on the order of only a few inches. The interconnecting member may be elastic or non-elastic, and the interconnecting member is preferably connected to the pillows by means of releasable clasps, or the like.

In a further arrangement, two of the interconnecting devices are provided at spaced positions along the length of the pillows.

DETAILED DESCRIPTION

Figure 1:
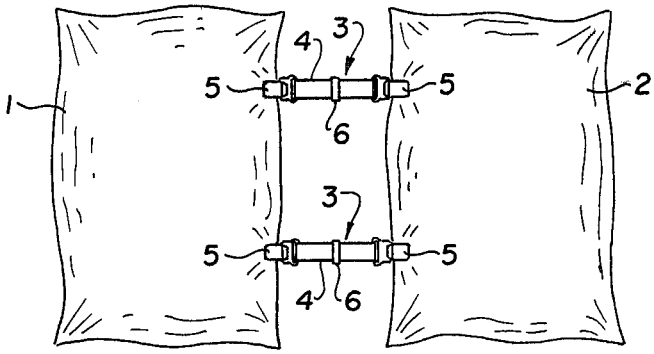
FIG. 1 is a front view of an embodiment of the present invention.
Figure 2:
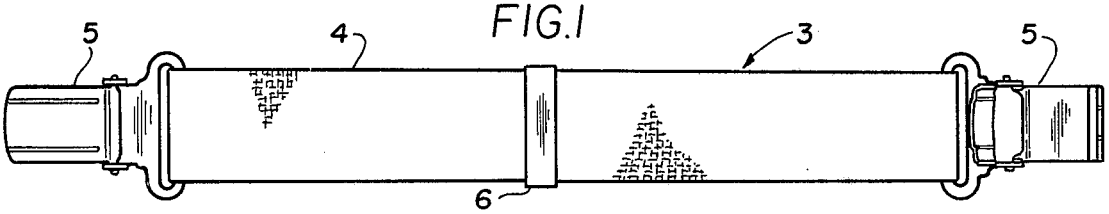
FIG. 2 is a front view of an interconnecting member for use in the present invention.
Figure 3:
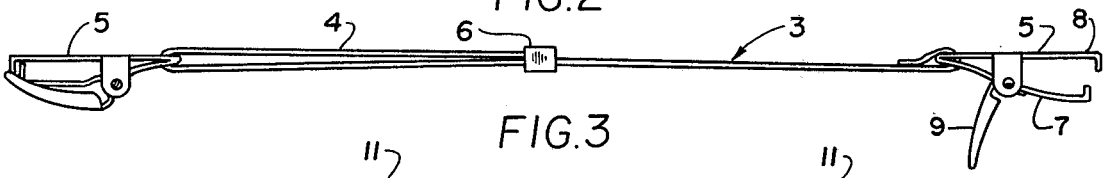
FIG. 3 is a top sectional view of the interconnecting device of FIG. 2.

Referring to FIGS. 1–3, a head support arrangement of the present invention comprises a pair of pillows 1,2 with at least one interconnecting means 3 coupling the pillows together with a spacing therebetween. The pillows may be a standard type of stuffed pillow found, for example on airlines, or may be an inflatable pillow or any other suitably shaped cushioning device. The head support arrangement comprises at least one interconnecting device 3. However, two interconnecting devices 3 may be provided at spaced positions along the length of the pillows, for example as illustrated in FIG. 1. It has been found that it is preferable to have the interconnecting devices located adjacent the upper end and adjacent the lower end of the pillows to insure that the interconnecting device does not interfere with the head of the user. If only one interconnecting device is used, it may be placed any where along the length of the pillow. It has been found in use that even if a single interconnecting device is connected to the pillows at the upper end or even at the lower end, satisfactory lateral or side support of a head is obtained.

FIG. 2 illustrates the connecting device 3 in greater detail. The connecting device 3 comprises a strap member 4 which may be resilient or non-resilient, but which is preferably flexible. In a preferred embodiment, the strap member 4 is made of an elastic-type material. At the opposite ends of the strap member 4 are releasable clasps 5 of the type generally used, for example, in suspenders. The clasps 5 are made of springy metal (or plastic), elements 7, 8 thereof being normally sprung away from each other. Elements 7, 8 are closed by L-shaped clamp member 9 as shown on the left side of FIG. 3. The strap member 4 has an adjustment mechanism 6 to adjust the length thereof, thereby adjusting the spacing between the pillows for maximum comfort.

In use, the head support arrangemet is located just above the shoulders of the user, so that the head of the user may be placed in the vicinity of the spacing between the pillows. The pillows accordingly lie laterally of the head of the user and provide lateral or side support to prevent the user's head from falling off to the side, as is common in conventional airplane, train and bus seats.

Figure 4:
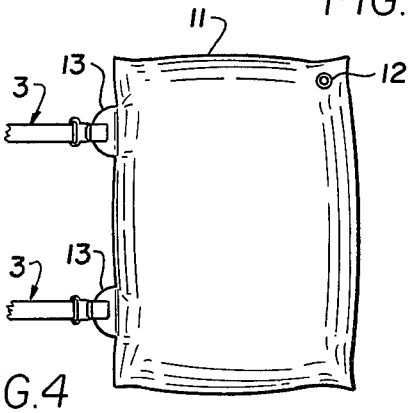
FIG. 4 is a modified arrangement of the present invention.
Figure 5:
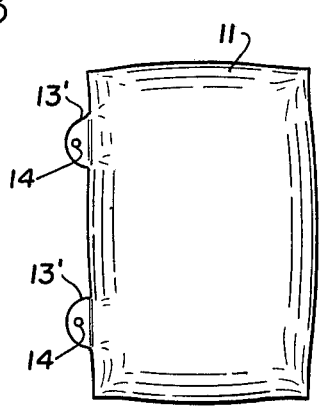
FIG. 5 illustrates a further modified arrangement of the present invention.
Figure 6:
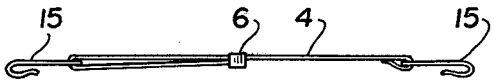
FIG. 6 illustrates a modified connecting member of the present invention.

FIG. 4 illustrates a modified arrangement of the present invention comprising a pillow-like member 11 which is inflatable by means of a conventional value 12, the details of which are not discussed herein. The pillow-like member 11 has tabs 13 extending therefrom which may be, for example, flat members extending from an edge of the pillow 11. The interconnecting members 3 are connectable to the tabs 13, as generally illustrated in FIG. 4. The interconnecting members 3 may be as shown in FIGS. 2 and 3, or any other suitable equivalent device. In a modified arrangement, as shown in FIG. 5, the tabs 13' have apertures 14 therein to receive a hook-like member at the end of the interconnecting member. A typical interconnecting member with hook-like members 15 at the ends thereof is shown in FIG. 6. The interconnecting member shown in FIG. 6 comprises an adjusting means 6 similar to that shown in FIG. 3. The portion 4 is preferably a flexible web-like member, as shown in FIG. 2, and is preferably a resilient elastic material.

Figure 7:
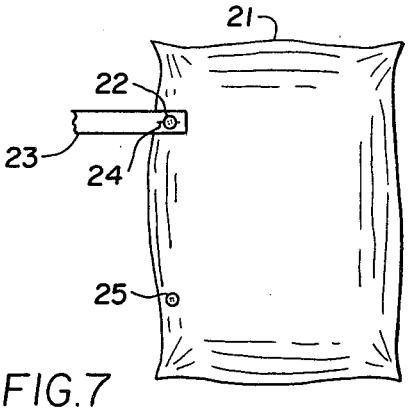
FIG. 7 illustrates a further embodiment of the invention.

FIG. 7 illustrates a pillow 21 with a button-like member 22 connected thereto. The connecting member 23 has a buttonhole 24 therein for connection to the button-like member 22. Only one pillow 21 is shown in FIG. 7 for convenience, but it is clear that the head support arrangement comprises two pillows, as shown in FIG. 1. The pillow 21 has a second button-like member 25 for connection with a second connecting member 23, if desired.

Figure 8:
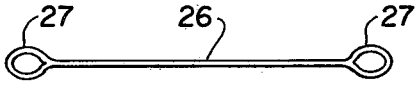
FIG. 8 illustrates another connecting device according to the present invention

FIG. 8 illustrates a modified connecting member 26 having loops 27 at the opposite ends thereof for connection to the button-like members 22 of the arrangement of FIG. 7. The connecting member 26 of FIG. 8 may be made of strand-type material and may be of fixed length, elastic or of adjustable length, as may be the web-like adjusting member 23 of FIG. 7. The loops 27 may be integral with the connecting member 26 and may be made of flexible material, or they may comprise rigid ring-like devices connected with the flexible member 26.

I claim:

1. A head support arrangement for supporting the head of a user when the user is seated, comprising:

a pair of individual, separable, pillows (1,2), each pillow having an edge surrounding the periphery thereof which includes at least one substantially straight elongated edge, said pillows being dimensioned to extend from the shoulders to above the head of a user; and connecting means including at least one connecting member (3) having quick releasable means (5) at the respective opposite ends thereof, said quick releasable means (5) each being releasably connected to said substantially straight elongated edge of a respective pillow so as to extend between said substantially straight elongated edges and connect the individual pillows together with a spacing between the interconnected substantially straight elongated edges of the respective pillows and with said connecting member located to be behind a head of a user when the head of a user is placed on the pillows in the vicinity of the spacing between the pillows, said connecting means spanning a distance in the longitudinal direction of said substantially straight elongated edge of each of said pillows which is substantially less than the length of said substantially straight elongated edges of the pillows being connected so that the pillows have free, unconnected opposing substantially straight elongated edge portions over a central major portion of said substantially straight elongated edges where the head of the user is placed on said pillows such that the user's head does not contact a connecting means, whereby the pillows provide lateral or side support to the head of the user without utilizing any means extending around to the front of the neck or head of the user, said connecting means being substantially small relative to the pillows and quickly releasable from the pillows without damaging the pillows to permit separation of the pillows.

2. The head support arrangement of claim 1 wherein said quick releasable means is a clasp.

3. The head support arrangement of claim 1 wherein said connecting member comprises a resilient, elastic member.

4. The head support arrangement of claim 1 further comprising at least two connecting members spaced from each other along the length of said pillows members.

5. The head support arrangement of claim 1 or 4 wherein said connecting member is of variable length.

6. The head support arrangement of claim 1 or 4 wherein said pillows are inflatable pillows with tab-like portions for interconnection to said connecting member (3).

7. The head support arrangement of claim 1 or 4 wherein said at least one connecting member (3) is an elongated flexible member.

* * * * *

UNITED STATES PATENT AND TRADEMARK OFFICE

CERTIFICATE OF CORRECTION

PATENT NO. : 4,345,345

DATED : August 24, 1982

INVENTOR(S) : Leonard HOLTZ

It is certified that error appears in the above—identified patent and that said Letters Patent is hereby corrected as shown below:

Column 4, lines 19 and 20, change "said pillows members"

to --said pillows--.

Signed and Sealed this

*Sixteenth* Day of *November 1982*

[SEAL]

*Attest:*

GERALD J. MOSSINGHOFF

*Attesting Officer*

*Commissioner of Patents and Trademarks*